US010950981B2

(12) United States Patent
Chou et al.

(10) Patent No.: US 10,950,981 B2
(45) Date of Patent: Mar. 16, 2021

(54) ELECTRICAL CONNECTOR FOR HIGH FREQUENCY USE WITH DUAL ORIENTATION

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Chih-Hsien Chou, San Jose, CA (US); Xiao-Qin Zheng, Kunshan (CN); Shan-Yong Cheng, New Taipei (TW)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/654,040

(22) Filed: Oct. 16, 2019

(65) Prior Publication Data

US 2020/0119497 A1 Apr. 16, 2020

Related U.S. Application Data

(60) Provisional application No. 62/746,008, filed on Oct. 16, 2018.

(51) Int. Cl.
*H01R 13/6585* (2011.01)
*H01R 13/41* (2006.01)
(Continued)

(52) U.S. Cl.
CPC ..... *H01R 13/6585* (2013.01); *H01R 13/41* (2013.01); *H01R 13/502* (2013.01);
(Continued)

(58) Field of Classification Search
CPC ..... H01R 13/41; H01R 13/502; H01R 13/64; H01R 13/6461; H01R 13/6585; H01R 13/6586; H01R 2107/00; H01R 24/64
See application file for complete search history.

(56) References Cited

U.S. PATENT DOCUMENTS 9,214,766 B1 * 12/2015 Yu ..... H01R 13/6585
9,496,653 B2 * 11/2016 Little ..... H01R 12/724
(Continued)

FOREIGN PATENT DOCUMENTS

CN 203883254 U 10/2014
CN 204696300 U 10/2015
(Continued)

*Primary Examiner* — Oscar C Jimenez
(74) *Attorney, Agent, or Firm* — Wei Te Chung; Ming Chieh Chang

(57) ABSTRACT

An electrical connector includes an insulative housing with a rear base and a mating tongue extending forwardly from the base. Two rows of contacts are retained in the housing. A metallic shielding plate is embedded within the housing and between the two rows of contacts. Each row of contacts defines positions from one to twelve in the transverse direction wherein positions 2&3 and 10&11 are designated for high frequency signal transmission. In the shielding plate the space between corresponding positions 4 and 6, and that between corresponding positions 7 and 9, are of a complete or enlarged hole being essentially fully empty along the front-to-back direction for achieving the high frequency transmission without undesired crosstalk among the corresponding contacts.

20 Claims, 23 Drawing Sheets

(51) Int. Cl.

| | |
|---|---|
| ***H01R 24/64*** | (2011.01) |
| ***H01R 13/6461*** | (2011.01) |
| ***H01R 13/502*** | (2006.01) |
| ***H01R 107/00*** | (2006.01) |

(52) U.S. Cl.
CPC ..... *H01R 13/6461* (2013.01); *H01R 24/64* (2013.01); *H01R 2107/00* (2013.01)

(56) References Cited

U.S. PATENT DOCUMENTS

| | | | | |
|---|---|---|---|---|
| 9,577,387 | B2 * | 2/2017 | Hu | H01R 13/648 |
| 10,522,924 | B2 * | 12/2019 | Huang | H01R 12/716 |
| 2009/0156027 | A1 | 6/2009 | Chen | |
| 2014/0364006 | A1 * | 12/2014 | Lo | H01R 13/6461 439/607.01 |
| 2015/0171573 | A1 * | 6/2015 | Little | H01R 13/6658 439/607.34 |
| 2015/0244118 | A1 * | 8/2015 | Lin | H01R 13/426 439/357 |
| 2016/0056593 | A1 * | 2/2016 | Miyoshi | H01R 24/60 439/676 |
| 2017/0085021 | A1 * | 3/2017 | Tsai | H01R 12/716 |
| 2017/0110817 | A1 * | 4/2017 | Tsai | H01R 13/6585 |
| 2017/0331229 | A1 * | 11/2017 | Cheng | H01R 13/6585 |
| 2017/0352968 | A1 * | 12/2017 | Zhang | H01R 24/60 |
| 2018/0138621 | A1 * | 5/2018 | Zhao | H01R 13/648 |
| 2019/0089095 | A1 * | 3/2019 | Toda | H01R 13/6461 |
| 2019/0229470 | A1 * | 7/2019 | Cheng | H01R 24/60 |

FOREIGN PATENT DOCUMENTS

| | | | |
|---|---|---|---|
| CN | 204885681 | U | 12/2015 |
| CN | 207925720 | U | 9/2018 |

* cited by examiner

Figure 2-1 USB Type-C Receptacle Interface (Front View)

| A1 | A2 | A3 | A4 | A5 | A6 | A7 | A8 | A9 | A10 | A11 | A12 |
|---|---|---|---|---|---|---|---|---|---|---|---|
| GND | TX1+ | TX1- | VBUS | CC1 | D+ | D- | SBU1 | VBUS | RX2- | RX2+ | GND |
| | | | | | | | | | | | |
| GND | RX1+ | RX1- | VBUS | SBU2 | D- | D+ | CC2 | VBUS | TX2- | TX2+ | GND |
| B12 | B11 | B10 | B9 | B8 | B7 | B6 | B5 | B4 | B3 | B2 | B1 |

100

ELECTRICAL CONNECTOR FOR HIGH FREQUENCY USE WITH DUAL ORIENTATION

CROSS REFERENCE TO RELATED APPLICATIONS

This application claims the benefit of and priority to, U.S. Provisional Patent Application No. 62/746,008, filed Oct. 16, 2018, the contents of which are incorporated entirely herein by reference.

BACKGROUND OF THE DISCLOSURE

1. Field of the Disclosure

The present disclosure relates to an electrical connector, and more particularly to an electrical connector having the USB Type C mechanical configuration mechanically with some variation of the Display Port electrical characters.

2. Description of Related Arts

USB Type C connectors have been more and more popularly used in the communication field since August 2014 when it was first publicly announced. The traditional USB Type C receptacle connector essentially includes a mating tongue with two rows of contacts exposed on two opposite mating surfaces of the mating tongue and a metallic shielding plate embedded within the mating tongue between the two rows of contacts. The two rows of contacts are totally twenty-four contacts with the pin assignment as shown in FIG. 1(A). Notably, the middle shielding plate is used for shielding, grounding and reinforcing for the whole connector as mentioned in U.S. Pat. No. 9,484,681. Anyhow, during practical use other issues other than the shielding, grounding and reinforcing issues are involved with and concerned about, including how to cooperate, by means of some contact positioning holes and housing forming holes during making the whole connector via an insert-molding process with a successive assembling process, and/or avoid the potential sparkling under a high power voltage delivery, etc. A Chinese Patent Application No. CN201820005493.1 having one same applicant discloses a structure of the metallic shielding plate, as shown in FIG. 1(B), used in the Type C receptacle connector which may meet the mechanical and electrical requirements thereof. U.S. Pat. No. 9,923,286 also discloses a similar earlier design. Anyhow, recently some variations based upon the USB Type C connector are promoted in which the differential pair contacts located at positions 2/3 and 10/11 are required to perform the Display Port signals under high frequency transmission. Because the different electrical characters are performed, the shielding plate also requires to be modified compared with what is shown in FIG. 1(B). Anyhow, because the space in the shielding plate is limited, it is relatively difficult to design a metallic shielding plate to meet all the requirements in making an electrical Type C receptacle connector, either mechanically in making or electrically in using. In other words, the hole arrangement in the metallic shielding plate is required to be balanced from the mechanical viewpoint and the electrical viewpoint.

An improved electrical connector is desired.

SUMMARY OF THE DISCLOSURE

Accordingly, an object of the present disclosure is to provide a USB Type C receptacle connector with a metallic shielding plate in the mating tongue wherein the shielding plate is equipped with specifically arranged holes therein for meet not only the mechanical requirement during manufacturing but also the electrical requirement during using in a high frequency transmission.

To achieve the above object, an electrical connector includes an insulative housing with a rear base and a mating tongue extending forwardly from the base in a front-to-back direction. Two rows of contacts are retained in the housing. A metallic shielding plate is embedded within the housing and between the two rows of contacts. Each row of contacts defines positions from one to twelve in the transverse direction wherein positions 2&3 and 10&11 are designated for high frequency signal transmission. In the shielding plate the space between corresponding positions 4 and 6, and that between corresponding positions 7 and 9, are of a complete or enlarged hole being essentially fully empty along the front-to-back direction for achieving the high frequency transmission without undesired crosstalk among the corresponding contacts. Other portions of the shielding plate are equipped with holes designed for mechanical consideration during forming the housing via an insert-molding process with the shielding plate.

Other objects, advantages and novel features of the disclosure will become more apparent from the following detailed description when taken in conjunction with the accompanying drawings.

DETAILED DESCRIPTION OF THE PREFERRED EMBODIMENT

Figures 1A, 1B:
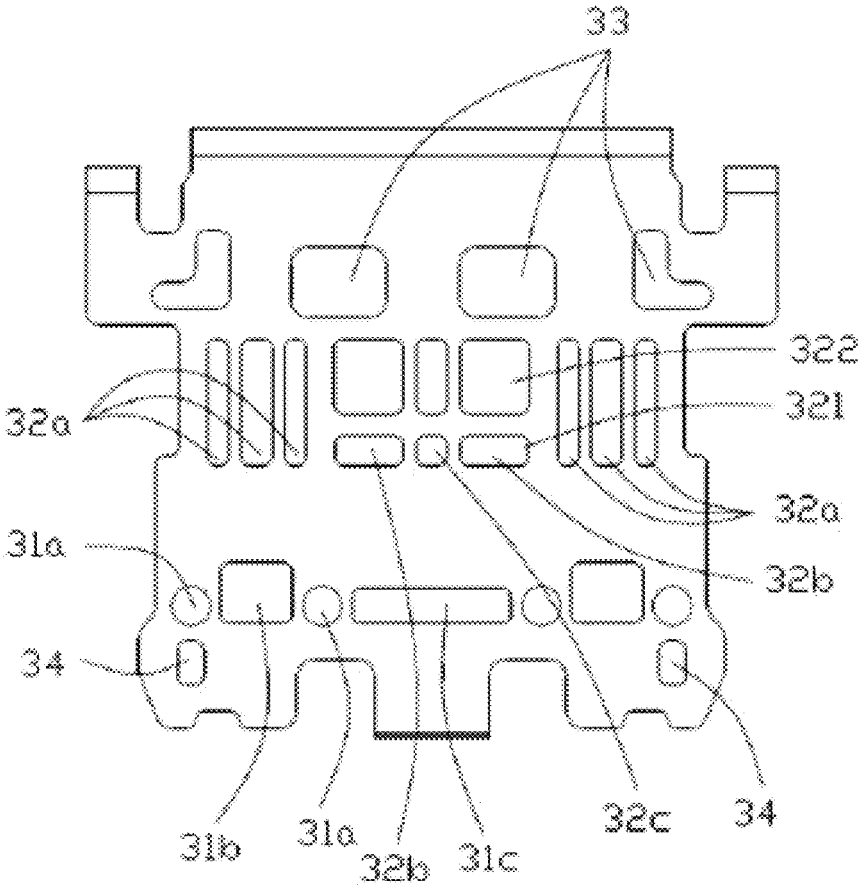
FIG. 1(A) (Prior Art)
FIG. 1(B) (Prior Art)
FIG. 1(A) is a diagram showing the pin assignment of the USB Type C receptacle connector.
FIG. 1(B) is an elevation view of the shielding plate disclosed in an unpublished earlier design for the typical Type C receptacle connector.
Figure 2A:
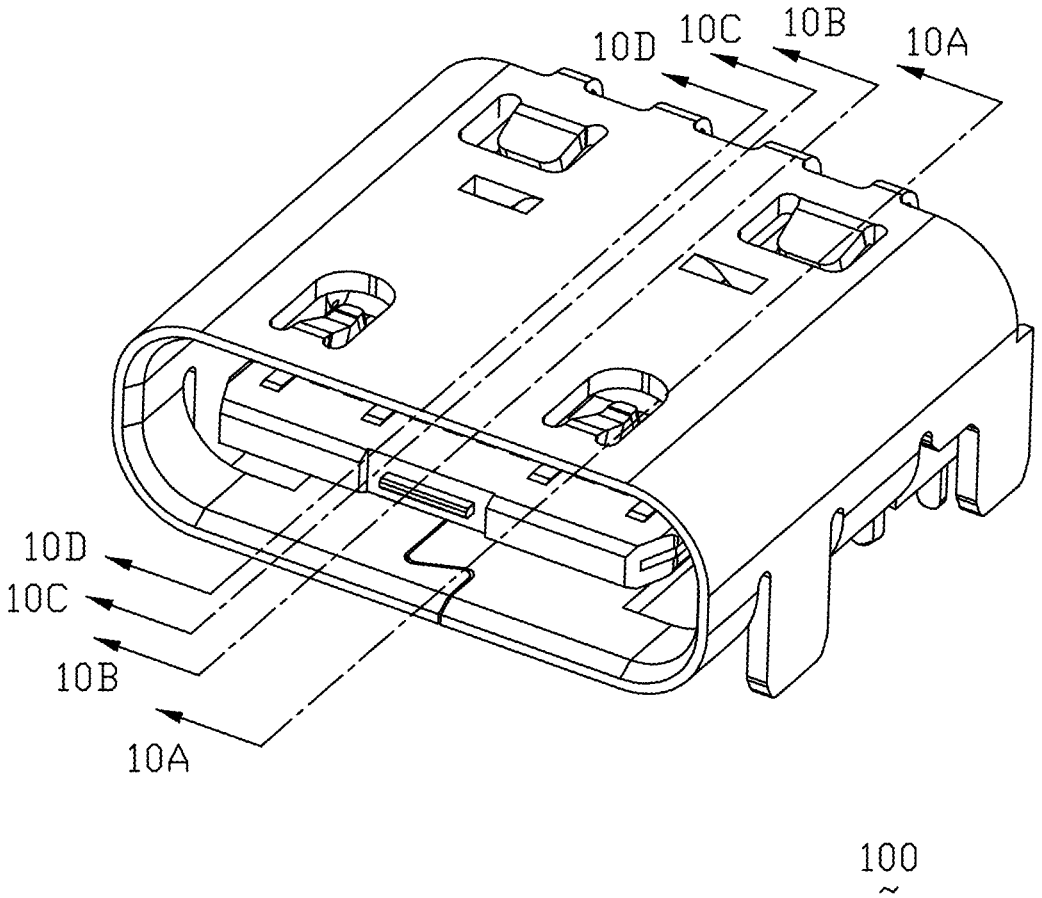
FIG. 2(A) is a perspective view of the electrical connector according to the first embodiment of the invention.
Figure 2B:
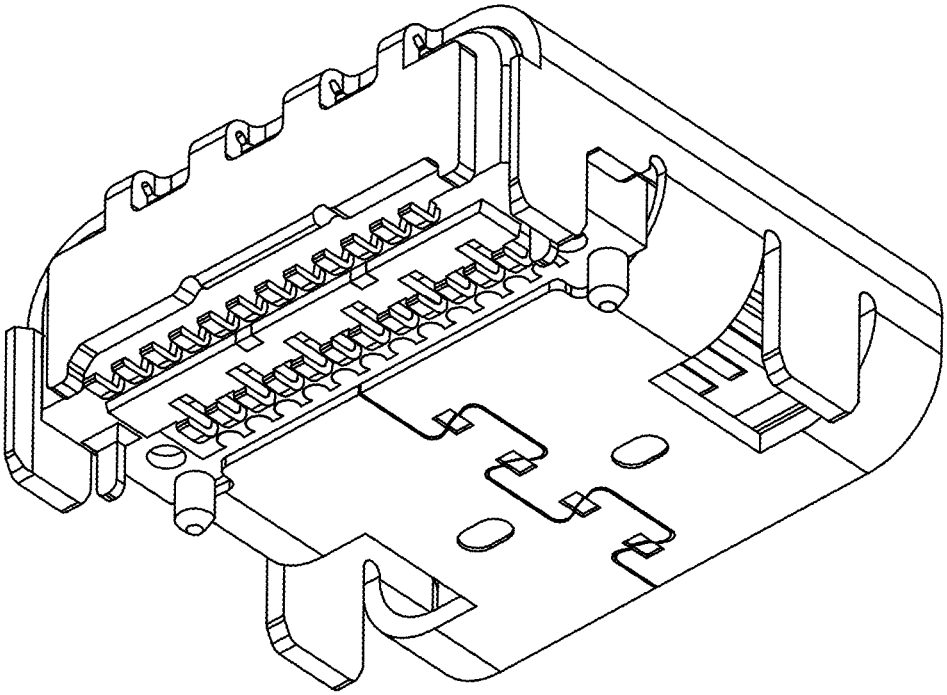
FIG. 2(B) is another perspective view of the electrical connector of FIG. 2(A)
Figure 3A:
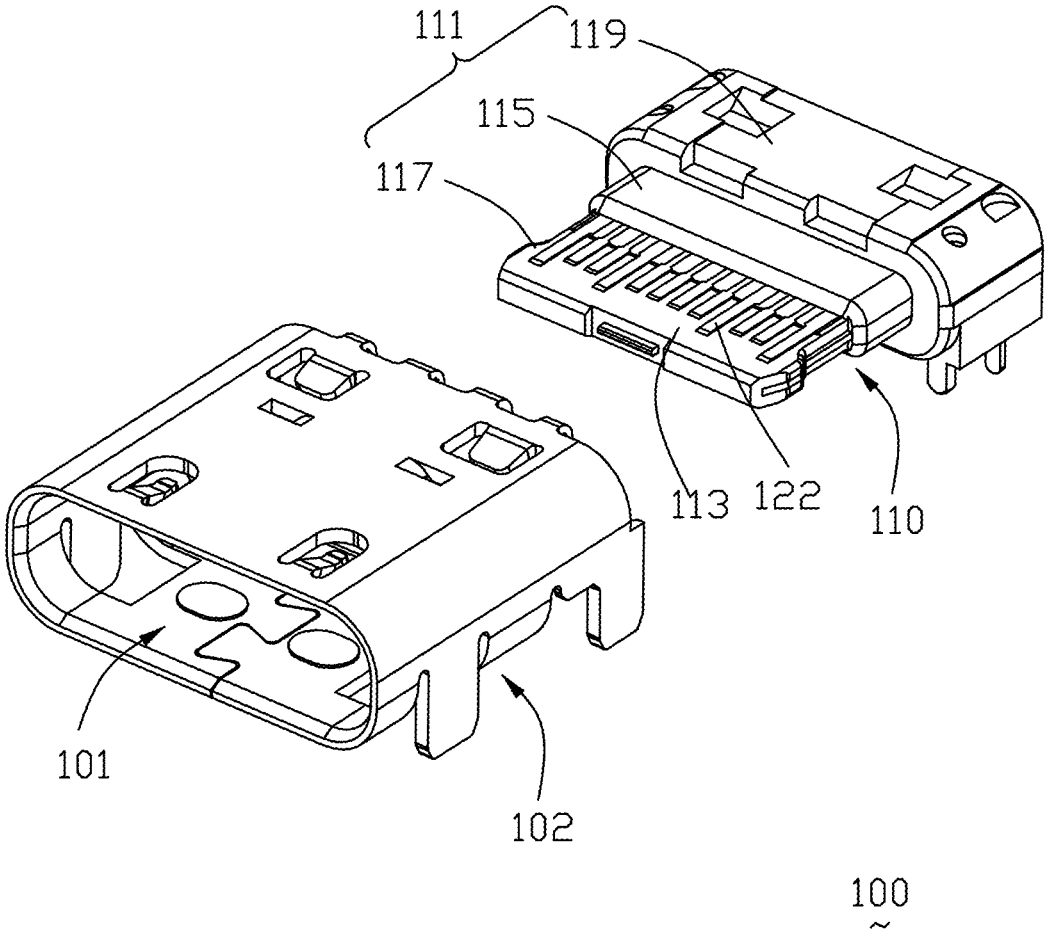
FIG. 3(A) is an exploded perspective view of the electrical connector of FIG. 2(A)
Figure 3B:
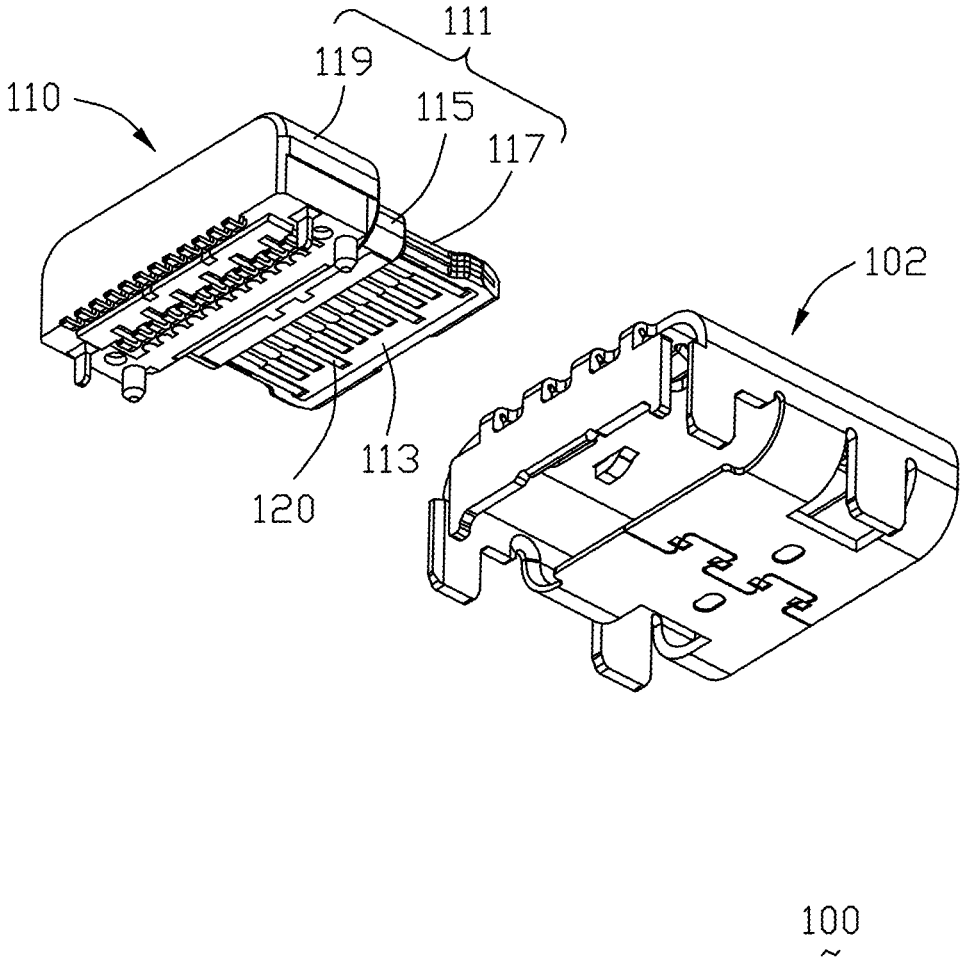
FIG. 3(B) is another exploded perspective view of the electrical connector of FIG. 3(A)
Figure 4A:
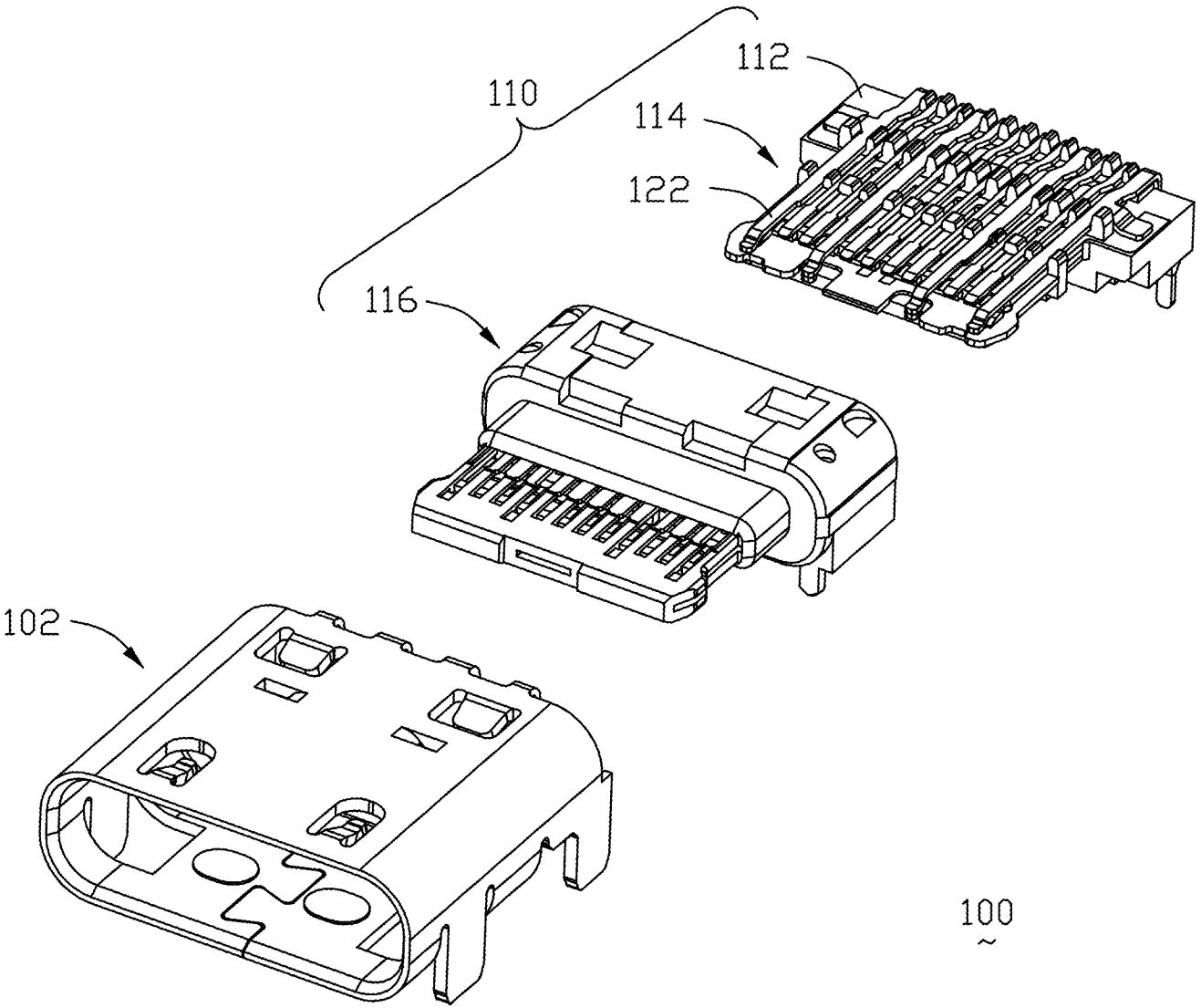
FIG. 4(A) is a further exploded perspective view of the electrical connector of FIG. 3(A)
Figure 4B:
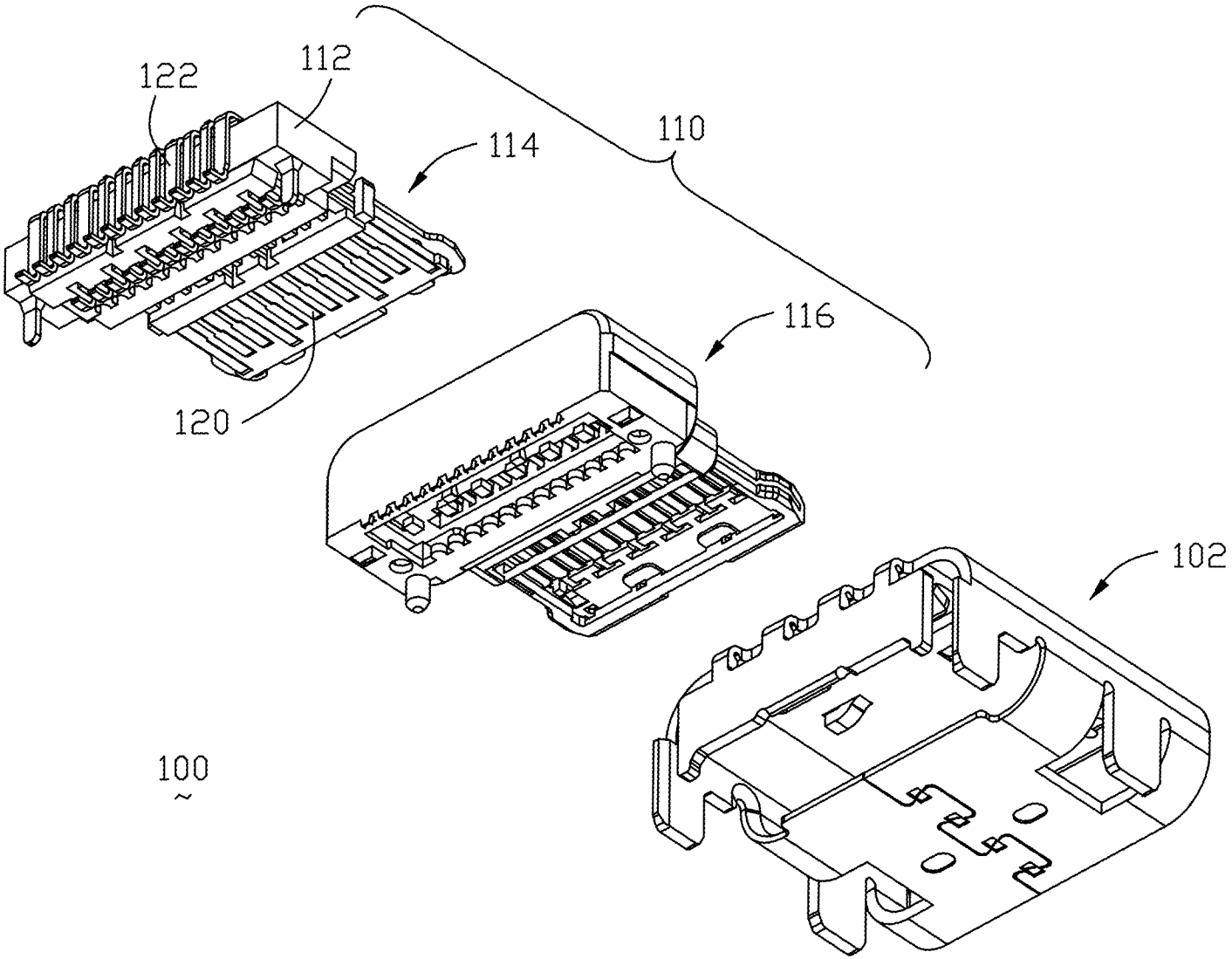
FIG. 4(B) is another further exploded perspective view of the electrical connector of FIG. 4(A)

Reference will now be made in detail to the embodiments of the present disclosure. The reference numerals are only referred to the respective different embodiments. The first embodiment is shown in FIGS. 2 to 10(D).

An electrical connector 100 includes a contact module 110 received within a metallic shield 102 to commonly form a mating cavity 101 for receiving a complementary plug (not shown). In this embodiment, the contact module 110 is made via two-stage insert-molding process. Anyhow, other manufacturing methods are available understandably. In this embodiment, the contact module 110 includes a plurality of lower contacts 120 in one row and a metallic shielding plate 130 initially integrally formed within an inner insulator 112 to commonly form a contact subassembly 114 via a first stage insert-molding process, and further successively cooperating with a plurality of upper contacts 122 in another row to be integrally formed within an outer insulator 116 to form the complete contact module 110 via a second stage insert-molding process. The inner insulator 112 and the outer insulator 116 commonly form an insulative housing 111 including a rear base 119 and a mating tongue 117 extending forwardly from the base 119 along the front-to-back direction. Notably, the mating tongue 117 includes a thickened/stepped portion 115 around the root joined with the base portion 119 according to the USB Type C specification.

The lower contacts 120 and the upper contacts 122 are reversely symmetrically arranged with each other electrically as shown in the pin assignment table in FIG. 1(A). The lower contacts 120 includes two grounding contacts at positions 1 and 12, two power contacts at positions 4 and 9, two pairs of high speed differential pair at positions 2/3 and 10/11, one pair of high speed differential pair in place of low speed differential pair at positions 6/7, and a SBU and a CC at positions 8 and 5. The upper contacts 122 are arranged as well as the lower contacts 120.

Each of the lower contacts 120 and the upper contacts 122 includes a front mating section 123 exposed upon the corresponding mating surface 113 of the mating tongue 117, a rear mounting section 125 extending outside of the base 119, and a retaining section 127 therebetween in the front-to-back direction. Each contact includes a horizontal portion 1221 and a vertical portion 1222 bending from the horizontal portion 1221, the mounting section 125 bends from the vertical portion 1222, the vertical portion and the mounting section forms a leg. The mating section 123 and the retaining section 127 forms the horizontal portion 1221.

Three (front/middle/rear) rows of ribs 107 are formed on the inner insulator 112 to separate the corresponding upper contacts 122, and one row of protrusions 105 to support the front end of the upper contacts 122 during the second stage insert-molding process. The inner insulator 112 further includes a plurality of holes 103 for receiving the corresponding core pins (not shown) to support the front end of the lower contacts 120 during the first stage insert-molding process. The two-stage insert-molding of the contact module is essentially disclosed in the aforementioned U.S. Pat. No. 9,923,286. Notably, the grounding contacts mechanically and electrically connect to the shielding plate 130 in the vertical direction while the power contacts at positions 4 and 9 mechanically and electrically connect with each other in the vertical direction.

The shielding plate 130 includes a horizontal main body 132, a rear wall 134 and a pair of mounting legs 136 by two sides of the rear wall 134 wherein the rear wall 134 and the pair of mounting legs 136 commonly extend from the rear edge of the main body 132. The main body 132 can be categorized with different zones, along the front-to-back direction, with corresponding holes/notches performing the respective effects. Holes 150A in zone A allows the power contacts contact each other in the vertical direction. Holes 150B in zone B allow the two opposite big outermost protrusions 105 on the upper side extend therethrough so as to be unitarily linked with the other two opposite being outermost protrusions 105 on the lower side. Holes 150C in zone C allows the corresponding core pins to support the front end of the lower contacts 120 during the first stage insert-molding process. The hole 150D is used for adjusting electrical characteristic. Holes 150E in zone E are used to form the front row of ribs 107. Holes 150F in zone F are used to break the bridges linked between the contact carrier between every adjacent two lower contacts 120. Holes 150G in zone G are used to form the middle row of ribs 107. Holes 150H in zone H are used to form the rear row of ribs 107. Notably, in this embodiment, in different zones the holes between positions 4 and 6 as well as those between positions 7 and 9 are further unified together as one elongated large hole 200 along the front-to-back direction. Specifically, the elongated large hole 200 starts from zone C and ends at a rear edge of the main body 132 of the shielding plate 130. Generally, zones E and F corresponds to the stepped portion 115. Zones G and H corresponds to the rear base 119, and zones A, B, C and D corresponds to the mating tongue 117.

Notably, the main body 132 forms an elongated extension 202 between the two elongated large holes 200 and is essentially located at the centerline of the shielding plate 130 along the front-to-back direction. The elongated extension 202 forms holes in zones D, E, F and G wherein the holes in Zones D, E and F are aligned with the centerline while the hole 150G in zone G is offset from the centerline, and a cutout 210 is formed in a lateral edge of the extension correspondingly. Understandably, such an offset hole and the corresponding cut are formed for electrical performance consideration rather than the mechanical manufacturing consideration.

Understandably, compared with what is shown in the aforementioned U.S. Pat. No. 9,923,986 and what is shown in FIG. 1(B), the invention intentionally provides an elongated large hole 200 corresponding to the space between positions 4 and 6 as well as space between positions 7 and 9 for compliance with the strict electrical performance due to the four high speed differential pairs at positions 2/3, 10/11 in both the lower contacts 120 and the upper contacts 122 which are now running the Display Port signals instead of USB signals and the differential pairs at positions 6/7 transmitting the high speed signals instead of the low speed signals. Without these improvements and arrangement, the original design of the shielding plate as shown in the aforementioned U.S. Pat. No. 9,923,986 and FIG. 1(B) may not meet the electrical performance requirements. In other words, the holes arrangement in the shielding plate 130 in the invention is fit for both the electrical performance requirements, e.g., lowering crosstalk or interference issues, and the mechanical manufacturing requirements, e.g., providing direct or indirect support for retaining the corresponding lower contacts 120 and upper contacts 122 during either the first stage insert-molding process or the second stage insert-molding process. In brief, the holes arrangement in the shielding plate 130 also allows the whole shielding plate 130 performs the basic corresponding shielding, grounding, reinforcing and latching functions mentioned in the aforementioned U.S. Pat. No. 9,484,681.

Figure 5A:
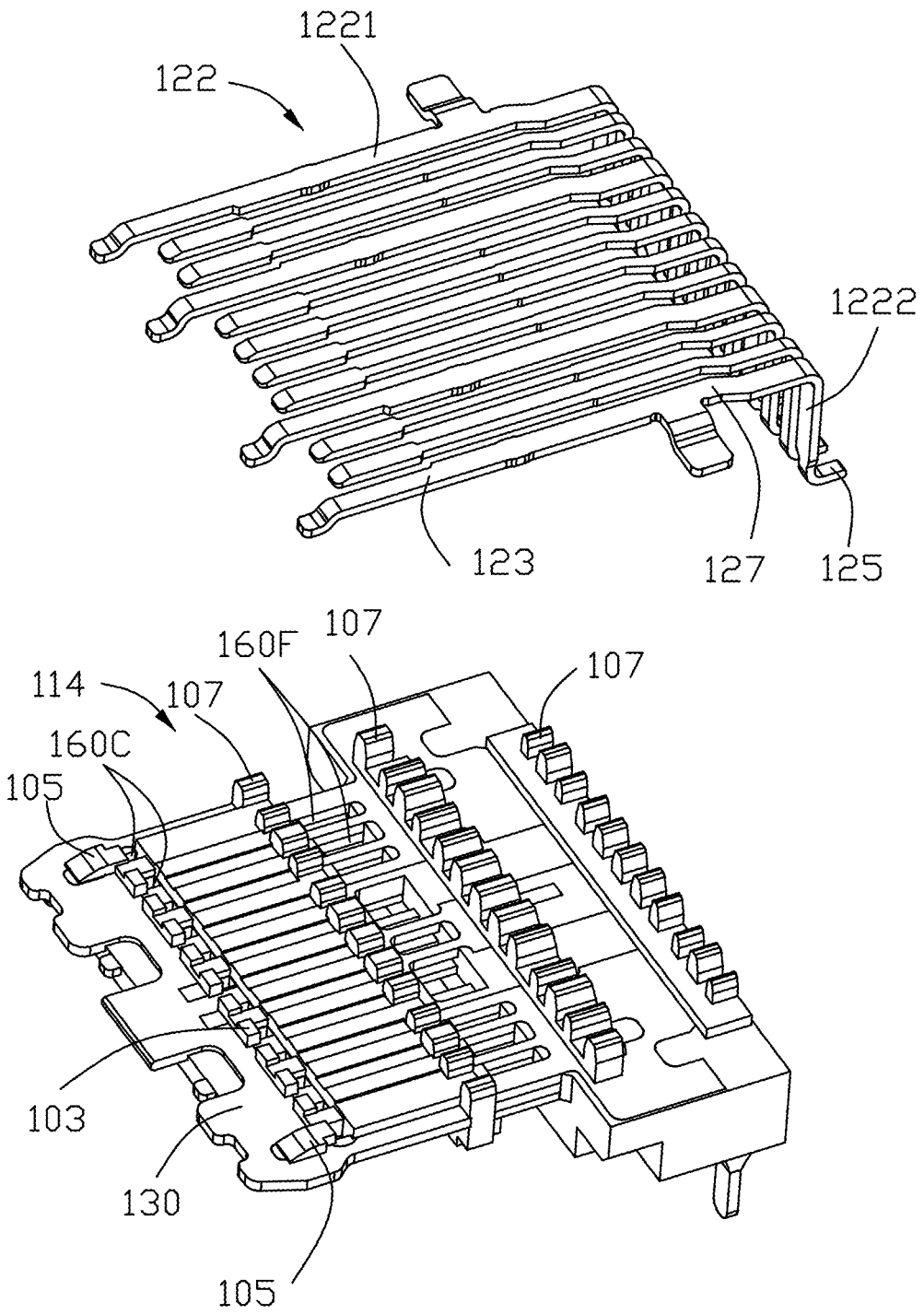
FIG. 5(A) is an exploded perspective view of the contact module of the electrical connector of FIG. 4(B) without the outer insulator.
Figure 5B:
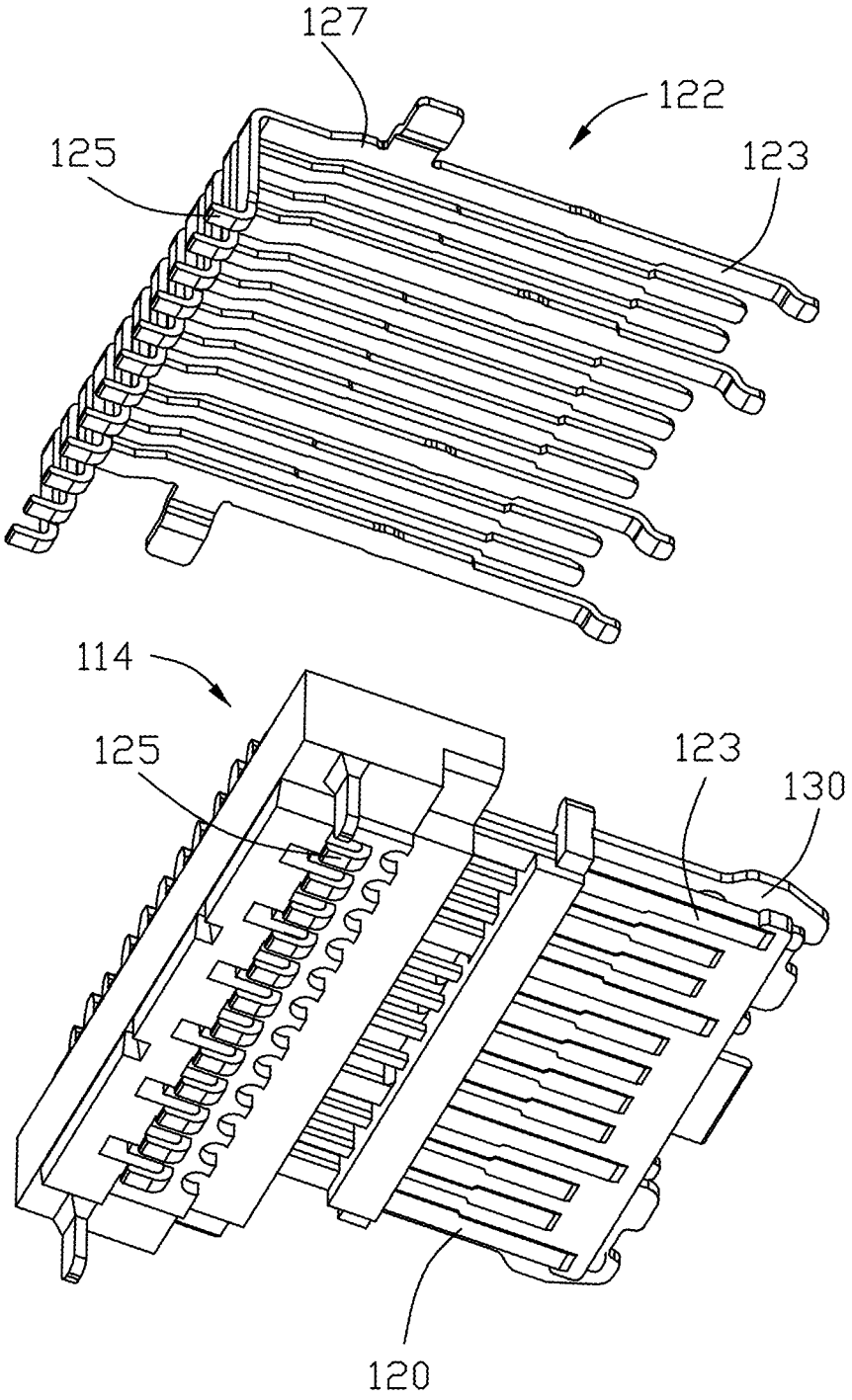
FIG. 5(B) is another exploded perspective view of the contact module of the electrical connector of FIG. 5(A)
Figure 6:
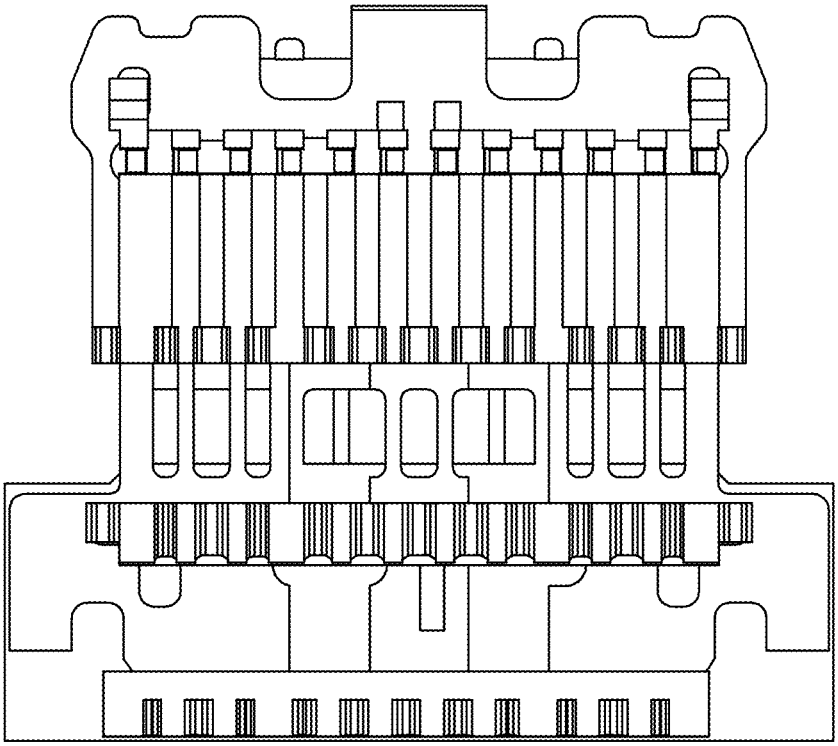
FIG. 6 is a top view of the contact module of the electrical connector of FIG. 5(A) without the upper contacts.
Figure 7A:
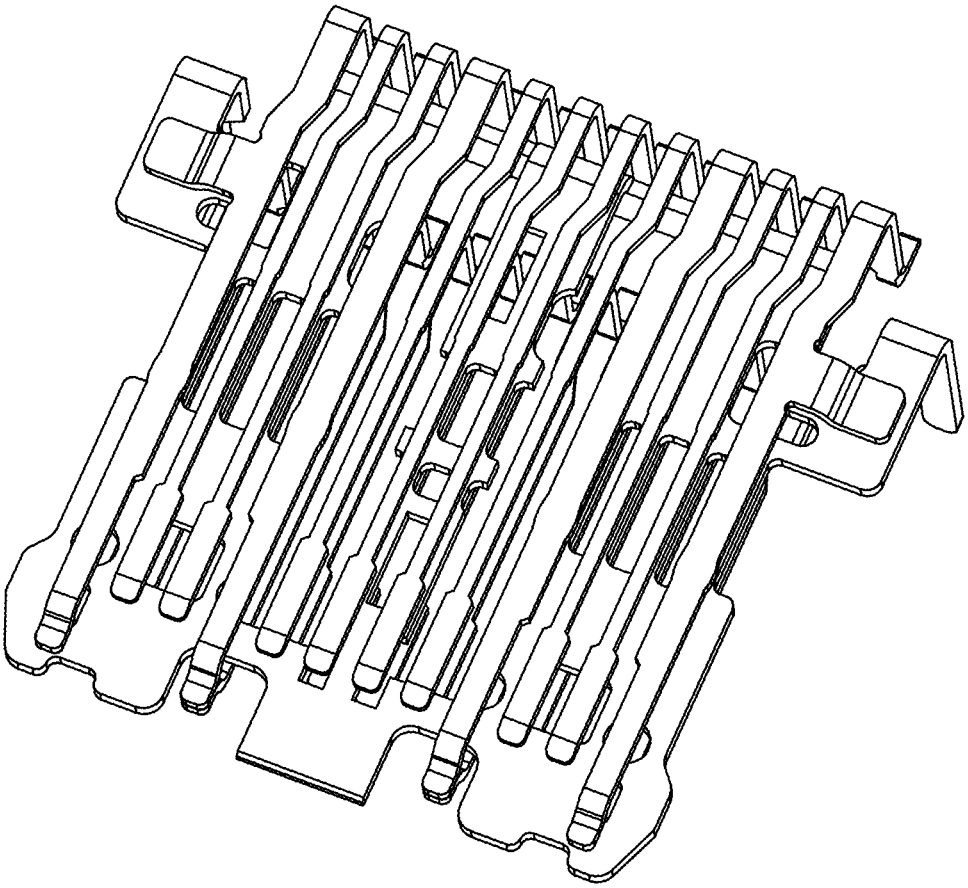
FIG. 7(A) is a perspective view showing the upper contacts, the lower contacts and the shielding plate therebetween of the contact module of the electrical connector of FIG. 5(A)
Figure 7B:
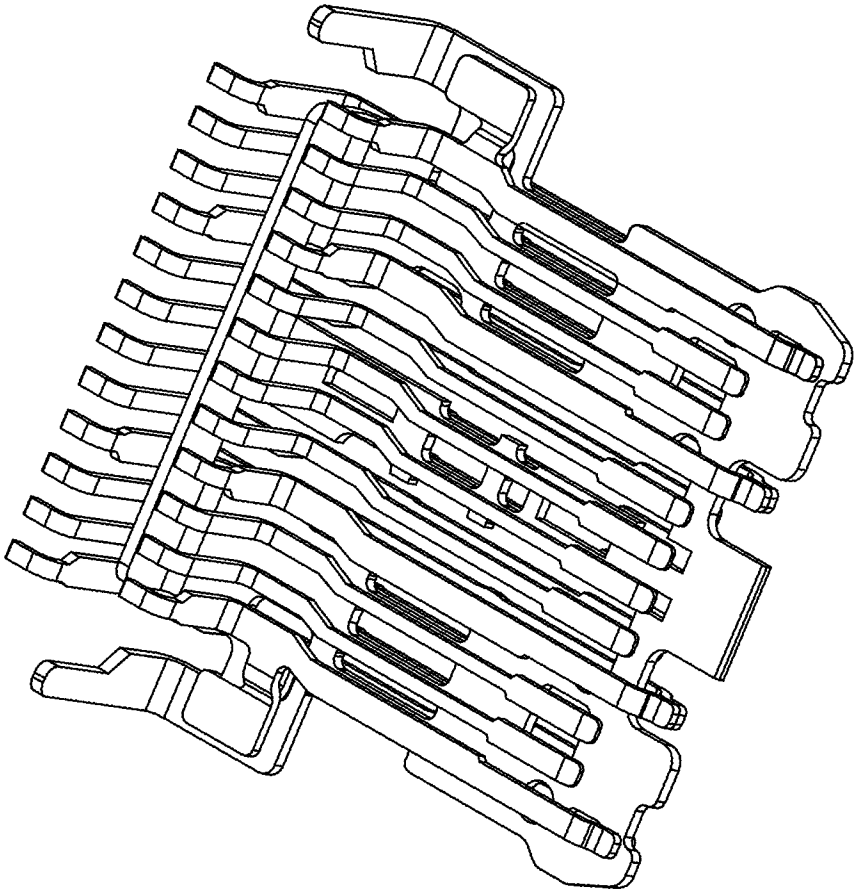
FIG. 7(B) is another perspective view showing the upper contacts, the lower contacts and the shielding plate therebetween of the contact module of the electrical connector of FIG. 7(A)
Figure 7C:
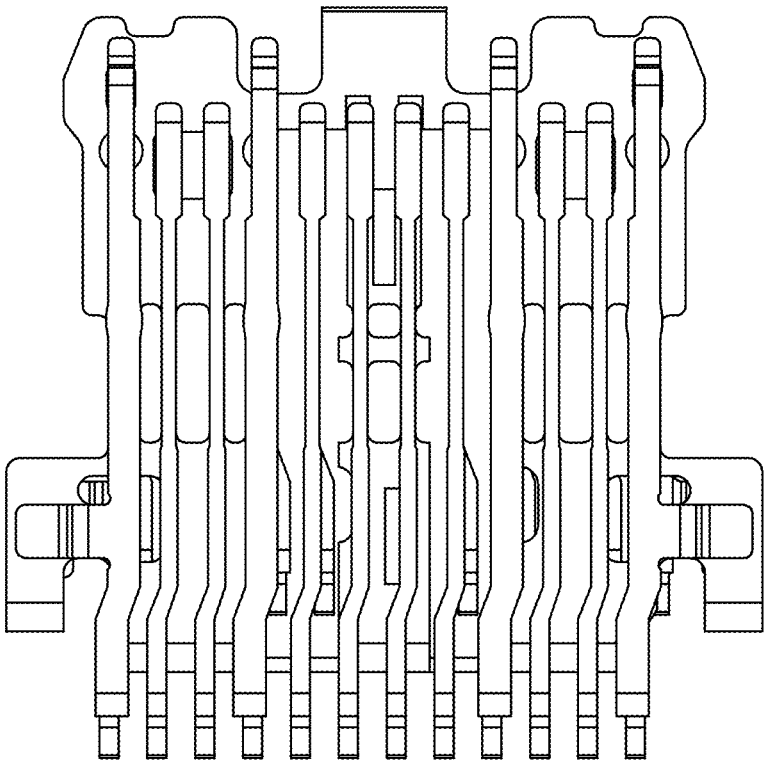
FIG. 7(C) is a top view showing the upper contacts, the lower contacts and the shielding plate therebetween of the contact module of the electrical connector of FIG. 7(A)
Figure 7D:
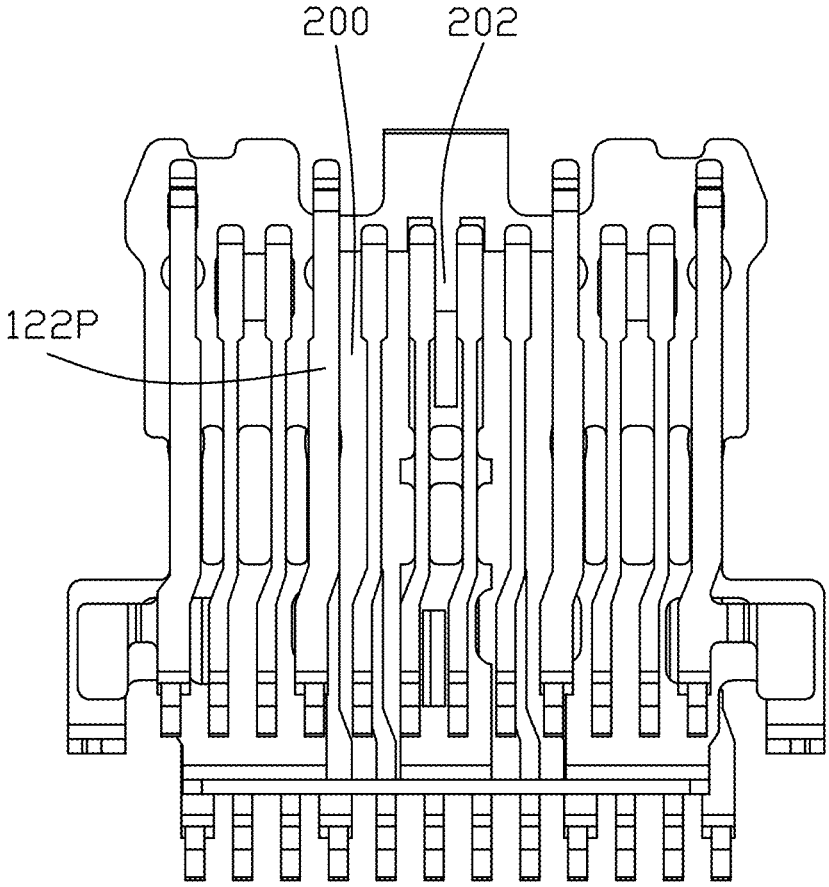
FIG. 7(D) is a bottom view showing the upper contacts, the lower contacts and the shielding plate therebetween of the contact module of the electrical connector of FIG. 7(A)
Figure 8A:
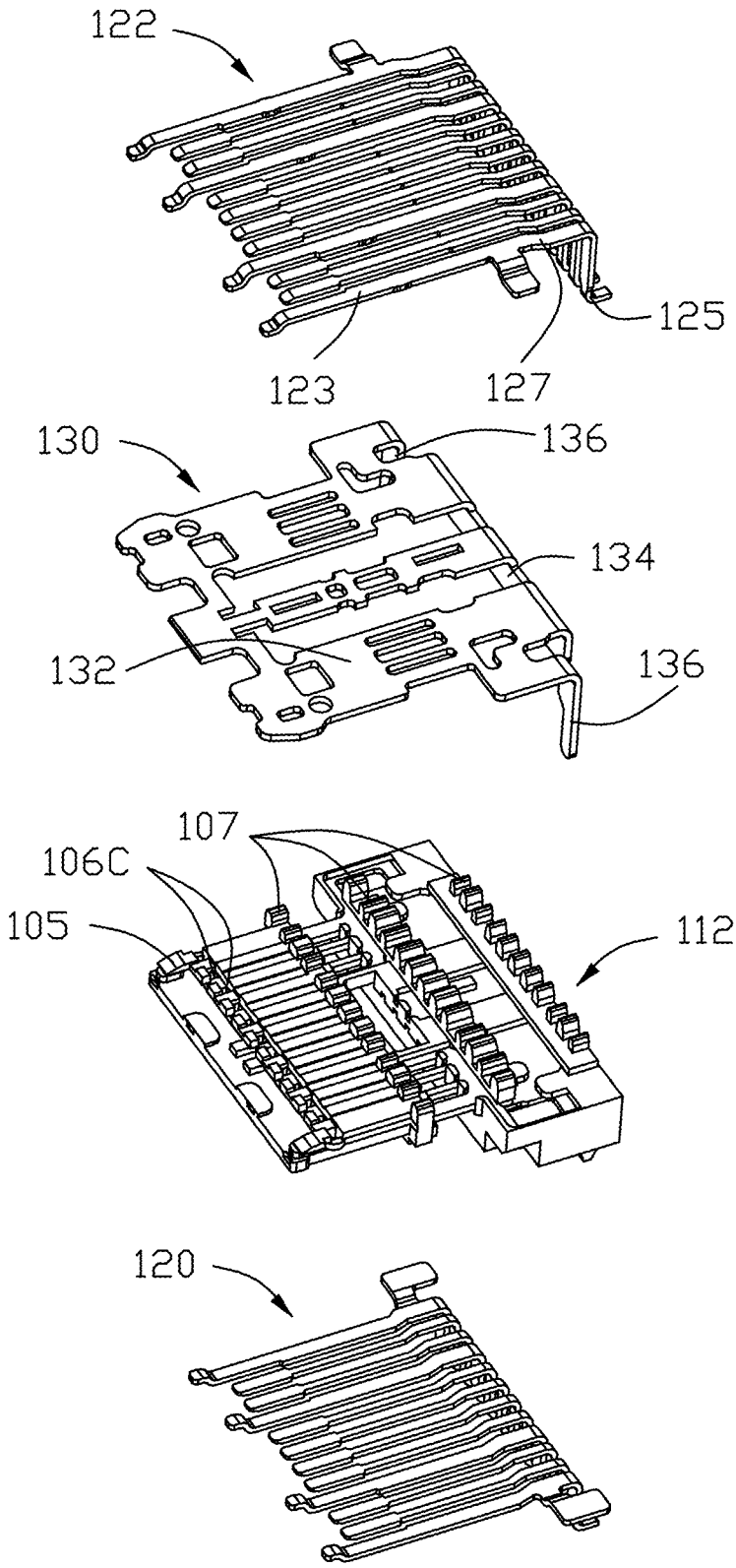
FIG. 8(A) is an exploded perspective view of the contact module of the electrical connector of FIG. 5(A)
Figure 8B:
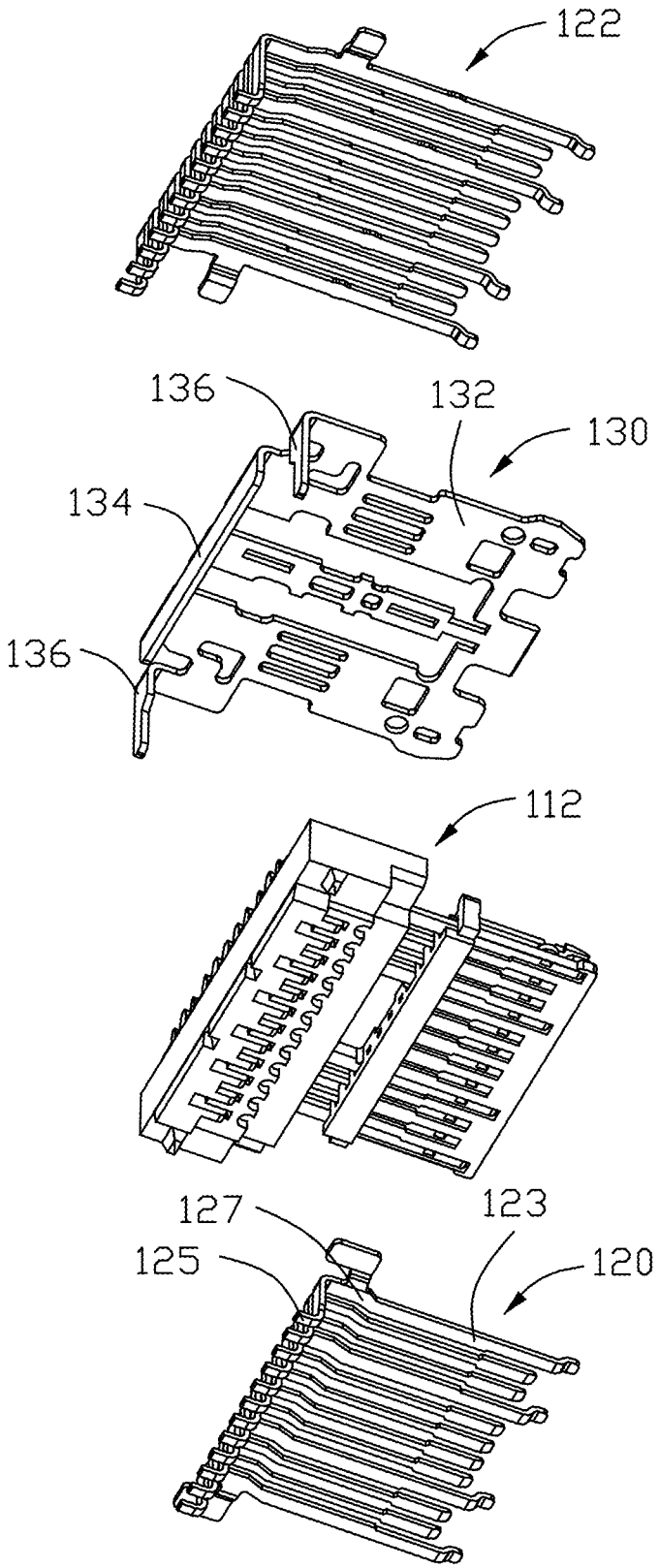
FIG. 8(B) is another exploded perspective view of the contact module of the electrical connector of FIG. 8(A)
Figure 9A:
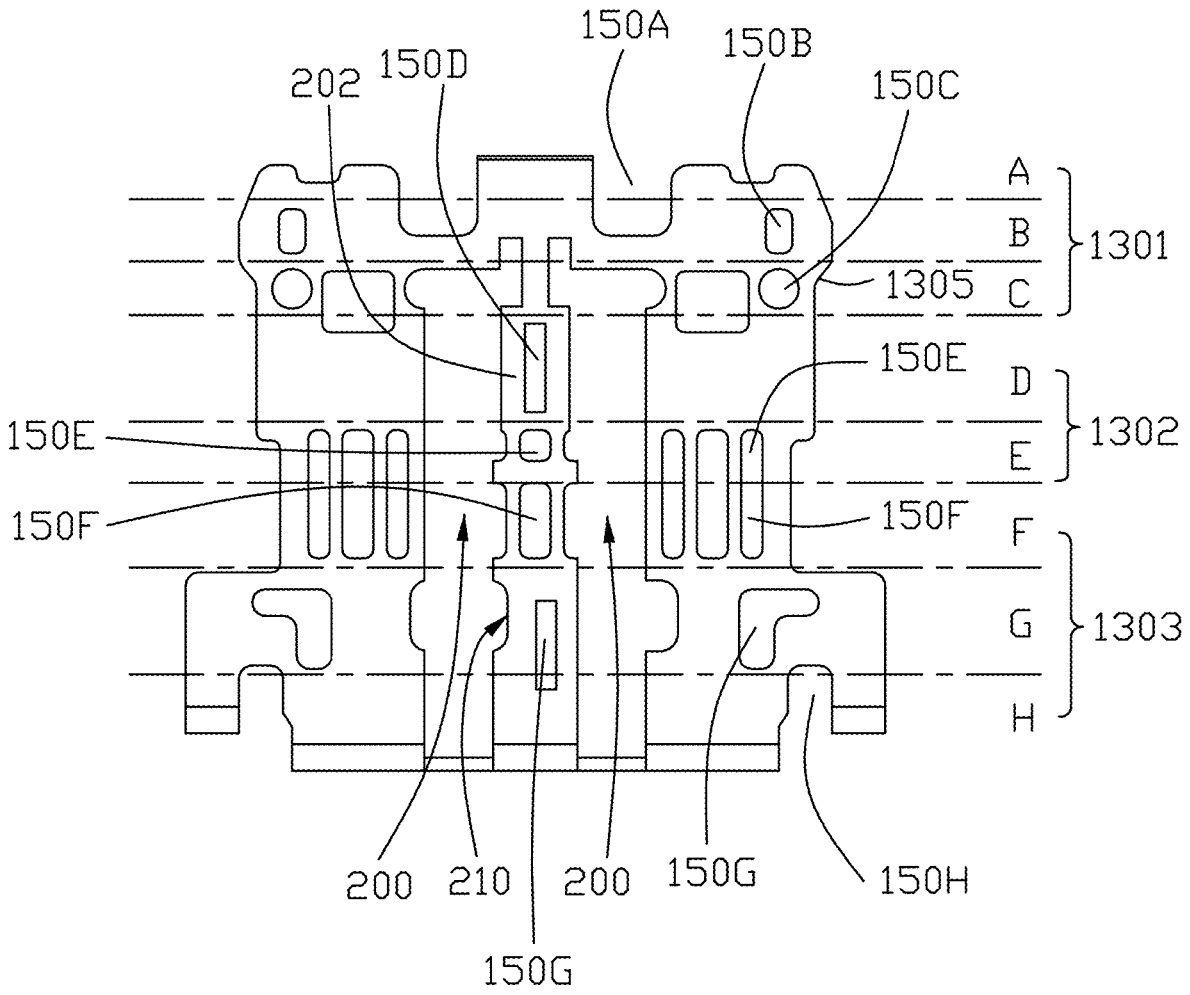
FIG. 9(A) is a top view of the shielding plate of the contact module of the electrical connector of FIG. 3(A)
Figure 9B:
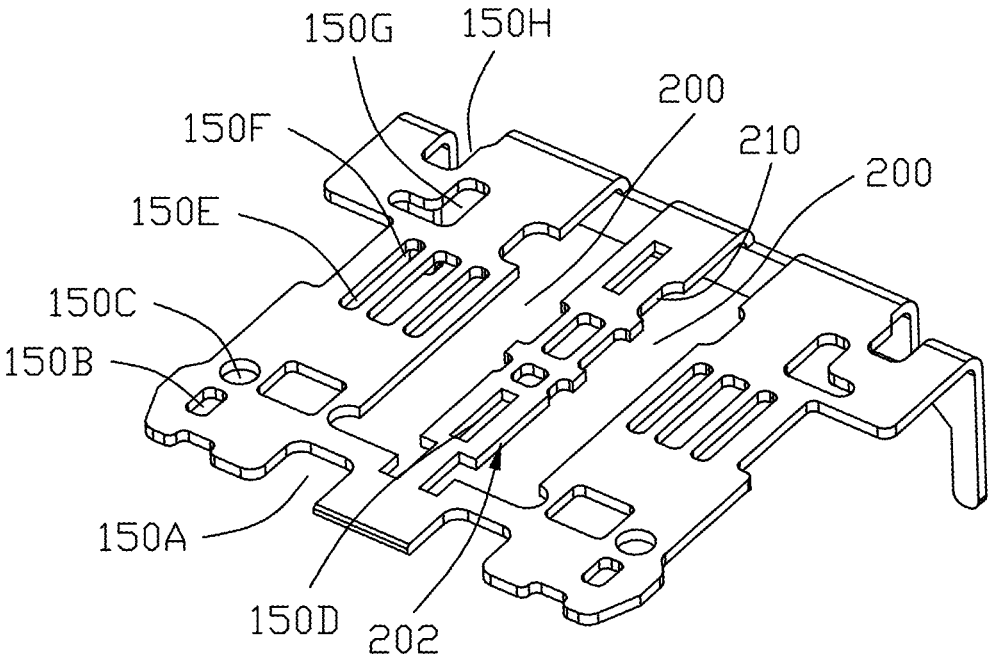
FIG. 9(B) is a perspective view of the shielding plate of the contact module of the electrical connector of FIG. 9(A)
Figure 10A:
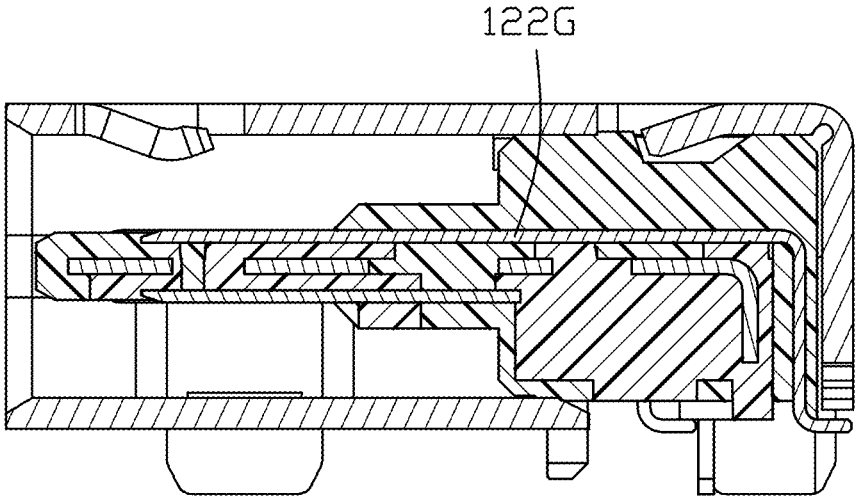
FIG. 10(A) is a cross-sectional view of the electrical connector of FIG. 2(A) along line 10A-10A.
Figure 10B:
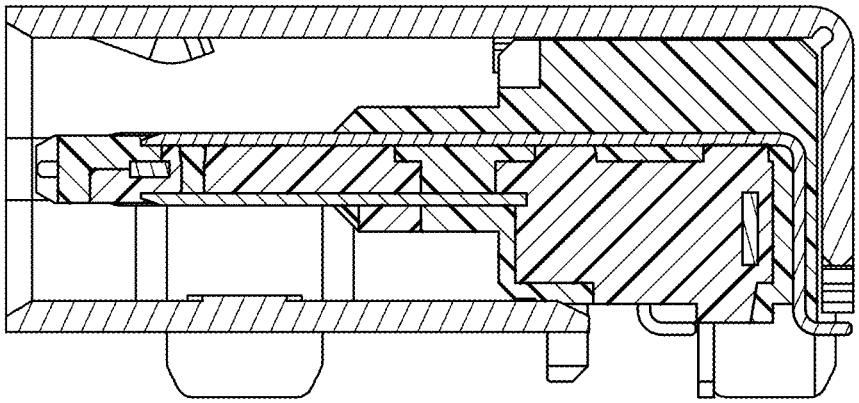
FIG. 10(B) is a cross-sectional view of the electrical connector of FIG. 2(A) along line 10B-10B.
Figure 10C:
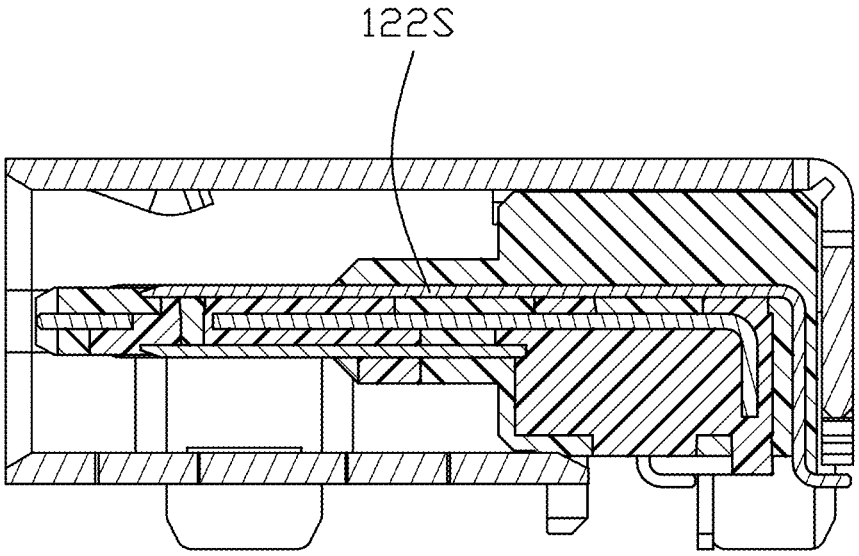
FIG. 10(C) is a cross-sectional view of the electrical connector of FIG. 2(A) along line 10C-10C.
Figure 10D:
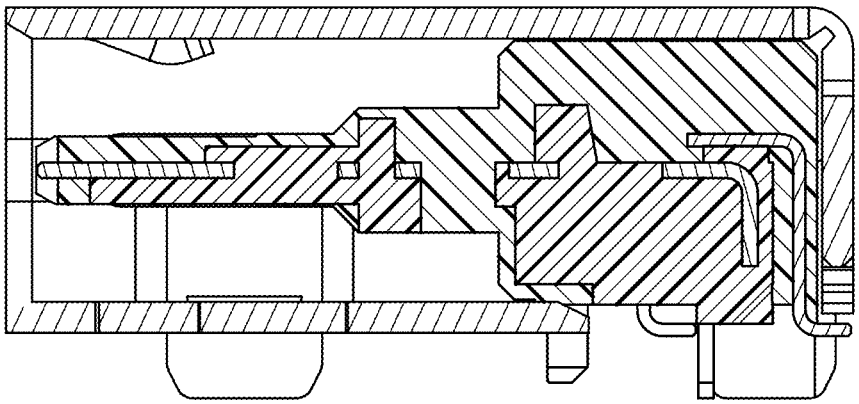
FIG. 10(D) is a cross-sectional view of the electrical connector of FIG. 2(A) along line 10D-10D.

Notably, some holes are either fully or initially partially filled by the inner insulator 112 during the first stage insert-molding process, and the partially filled holes are successively along with the remaining holes further filled by the outer insulator 116. FIGS. 10(A)-10(D) show how the inner insulator 112 and the outer insulator 116 are filled within the corresponding holes. Referring to FIG. 5(A), after the first stage insert-molding process, the inner insulator 112 forms a plurality of holes 160C and 160F corresponding to zones C and F wherein the holes 160C are blind holes while the holes 160F are through holes. Understandably, the holes 160C and 160F as well as the holes 150C and 150F aligned with the corresponding holes 160C and 160F, are filled with the outer insulator 116 during the second stage insert-molding process. In brief, in this embodiment, some holes like 150B are filled with only the inner insulator 112, some holes like hole 150F are filled with only the outer insulator 116, and others are filled with both.

As mentioned earlier, the undesired crosstalk is essentially derived from the high speed differential pairs of the lower contacts 120 at positions 2/3 and 10/11, and those of the upper contacts 122 at the positions 2/3 and 10/11, and further the differential pair of the lower contacts 120 at positions 6/7 and those of the upper contacts 122 at positions 6/7 which are originally of the low speed differential pairs but now transformed/converted to be the high speed differential pair. Notably, the positions are numbered for the upper contacts 122 are reversed with regard to those for the lower contacts 120. The elongated hole 200 is to eliminate resonance among those differential pairs. In this embodiment, the elongated hole 200 is dimensions, along the front-to-back direction, not less than 70% of the horizontal section of the contacts at positions 5 and 8 while not less than 40% of the horizontal section of the contacts at positions 4 and 9. Generally speaking, in the transverse direction there are three differential pairs at positions 2/3, 6/7 and 10/11, and the invention is to provide the enlarged hole 200 around positions 4/5 and 8/9 to eliminate the crosstalk among those differential pairs. In this embodiment, the holes 150G and 150H are located around the base 119, the holes 150E and 140F are located around the stepped portion 115, and holes 150A, 150B and 150C are positions corresponding to the mating surfaces. That is said, the main body of the shielding plates includes a front section 1301, a middle section 1302 and a rear section 1303 in a row and corresponding to a front portion of the mating tongue in front of the stepped portion, the stepped portion and the rear base. The elongate holes 200 continuously extend from the front section 1301 to the rear section 1303.

Figure 11:
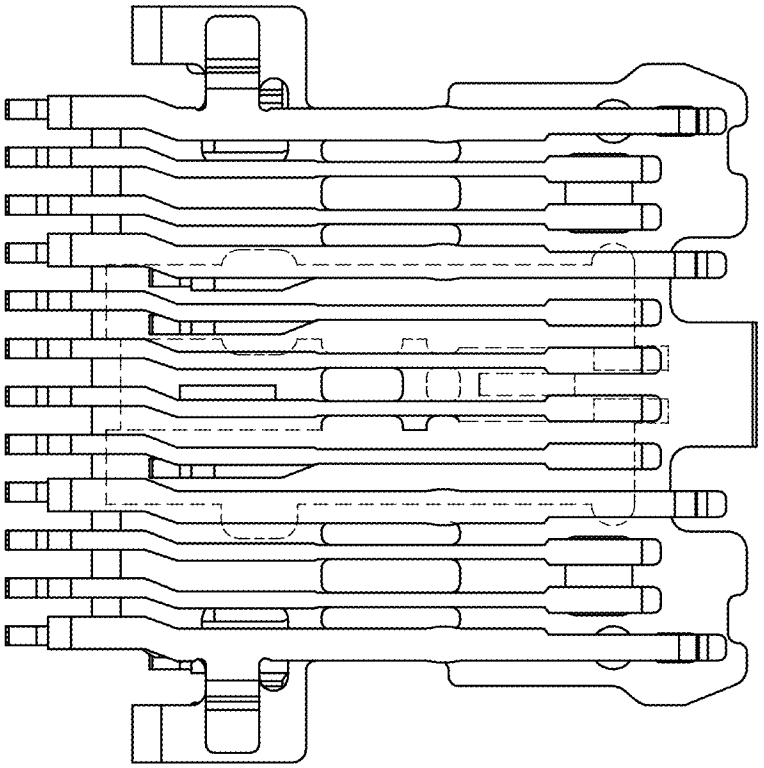
FIG. 11 shows the relationship between the elongated large hole and the corresponding contacts in a projection view.

From a technical viewpoint, around the area between the position 4 and position 6, the elongated large hole 200 extends from zone C to zone H in the front-to-back direction. As shown in FIG. 11, along the transverse direction, the average width of the elongated large hole 200 is about two times of a width of the average width of the power contact. In detail, in the vertical direction, the elongated large hole 200 is essentially not aligned with the contact which is located position 6/7, and partially, around one half, aligned with the contact which is located at position 4/9, and essentially fully aligned with the contact which is located at position 5/8. Correspondingly, the elongated extension 202 between the pair of elongated large holes 200 is vertically aligned with the contacts which are located at positions 6 and 7, and the Understandably, with this arrangement, the high frequency transmission can be performed.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

a metallic shield;

a contact module received within the metallic shield to commonly form a mating cavity for receiving a complementary plug connector, the contact module including an insulative housing with a base and mating tongue extending forwardly from the base in a front-to-back direction with a stepped portion at a root thereof to the base;

a plurality of contacts including a row of lower contacts and a row of upper contacts with a metallic shielding plate therebetween integrally formed within the insulative housing in a vertical direction perpendicular to the front-to-back direction; and the upper contacts as well as the lower contacts defining twelve positions in sequence along a transverse direction perpendicular to both the front-to-back direction and the vertical direction; wherein the contacts at positions 2/3, 6/7 and 10/11 are high speed differential pairs, and the shielding plate forms a pair of independent elongated holes generally respectively aligned with and corresponding to positions 5 and 8 and extending along the front-to-back direction;

wherein the shielding plate includes a horizontal planar main body and each of the elongated holes extends rearwardly without interruption and terminates around a rear edge of the shielding plate and extends forwardly without interruption and terminated around a front end of the contact at position 5 or 8.

2. The electrical connector as claimed in claim 1, wherein the elongated hole corresponding to the position 5 is further spanned and enlarged to reach position 4 in the transverse direction, and the elongated hole corresponding to the position 8 is further spanned and enlarged to reach position 9 in the transverse direction.

3. The electrical connector as claimed in claim 1, wherein the shielding plate defines a rear wall bending from the main body and the elongate holes are terminated at a joint of the main body and the rear wall.

4. The electrical connector as claimed in claim 3, wherein the shielding plate includes a pair of mounting legs extending downwardly from a rear edge of the main body and located at opposite sides of and distinct from the rear wall.

5. The electrical connector as claimed in claim 1, wherein the elongated hole is dimensioned, along the front-to-back direction, not less than 70% of a length of a horizontal section of the contact at the position 5 or 8.

6. The electrical connector as claimed in claim 1, wherein the shielding plate includes an elongated extension between the pair of elongated holes in the transverse direction and corresponding to the positions 6 and 7 and the elongated extension defines several distinct holes along the front-to-rear direction which are aligned with a space between positions 6 and 7.

7. The electrical connector as claimed in claim 1, wherein the lower contacts and the shielding plate are initially integrally formed with an inner insulator and successively along with the upper contacts to be commonly integrally formed within an outer insulator to form the complete contact module.

8. The electrical connector as claimed in claim 7, wherein said shielding plate further including a plurality of respective holes in different zones which are arranged along the front-to-back direction, and some of said holes are positioned and configured to be filled with the inner insulator, others of said holes are positioned and configured to be filled with the outer insulator, and remainders are positioned and configured to be filled with both the inner insulator and the outer insulator.

9. The electrical connector as claimed in claim 8, wherein the pair of elongated holes are filled with both the inner insulator and the outer insulator.

10. The electrical connector as claimed in claim 7, wherein said inner insulator forms at least one row of ribs located above an upper surface of the shielding plate and alternately arranged with the upper contacts in the transverse direction, and some holes are aligned with the ribs in the vertical direction.

11. The electrical connector as claimed in claim 7, wherein some of said holes are respectively aligned with the corresponding contacts in the vertical direction in a one-to-one relation while some of said holes are integrally formed as one big hole in the transverse direction aligned with multiple contacts in the vertical direction in a one-to-two or more relation.

12. An electrical connector comprising:

a contact module comprising an insulating housing, a shielding plate with a horizontal main body and legs, and a row of first contacts and a row of second contacts;

the insulating housing comprising a rear base and a mating tongue extending forwardly from the rear base with a stepped portion at a root thereof to the rear base;

the first and second rows of contacts with the main body of the shielding plate therebetween in a vertical direction integrally formed within the insulating housing;

the main body of the shielding plate including a front section, a middle section and a rear section in a row corresponding to a front portion of the mating tongue in front of the stepped portion, the stepped portion and the rear base, respectively; and the first contacts as well as the second contacts defining twelve positions in sequence along a transverse direction of the mating tongue; wherein the shielding plate forms a pair of distinct elongated holes generally respectively aligned with and corresponding to positions 5 and 8, each elongate hole continuously extends from the front section to the rear section of the shielding plate with no partition.

13. The electrical connector as claimed in claim 12, wherein the elongated hole corresponding to the position 5 is further spanned and enlarged to reach position 4 in the transverse direction, and the elongated hole corresponding to the position 8 is further spanned and enlarged to reach position 9 in the transverse direction.

14. The electrical connector as claimed in claim 13, wherein the contacts at positions 2/3, 6/7 and 10/11 are high speed differential pairs.

15. The electrical connector as claimed in claim 12, wherein the shielding plate includes a pair of mounting legs extending downwardly from a rear edge of the main body, and the pair of elongated holes are terminated around the rear edge of the shielding plate.

16. The electrical connector as claimed in claim 12, wherein the shielding plate includes an elongated extension between the pair of elongated holes in the transverse direction and corresponding to the positions 6 and 7, and the elongated extension defines several distinct holes along the front-to-rear direction which are aligned with a space between positions 6 and 7.

17. An electrical connector comprising:

a contact module including an insulative housing with a base and mating tongue extending forwardly from the base in a front-to-back direction with a stepped portion at a root thereof to the base;

a plurality of contacts including a row of lower contacts and a row of upper contacts with a metallic shielding plate therebetween integrally formed within the insulative housing in a vertical direction perpendicular to the front-to-back direction; and the upper contacts as well as the lower contacts defining twelve positions in sequence along a transverse direction perpendicular to both the front-to-back direction and the vertical direction; wherein the contacts at positions 6/7 are high speed differential pairs, the contacts at positions 4/9 are power contacts, and the shielding plate forms a pair of elongated holes generally respectively aligned with and corresponding to positions 5 and 8 and extending along the front-to-back direction wherein in a top view along the vertical direction, each elongated hole extends continuously without interruption with a length not less than three fourths of that of the shielding plate in the front-to-back direction.

18. The electrical connector as claimed in claim 17, wherein the shielding plate includes a horizontal main body and a vertical rear wall downwardly extending from a rear edge of the horizontal main body, and each elongated hole extends rearwardly beyond the rear edge of the main body and downwardly into the rear wall.

19. The electrical connector as claimed in claim 17, wherein an average width of the elongated hole is more than two times of that of the power contact in said transverse direction.

20. The electrical connector as claimed in claim 17, wherein in the vertical direction, the elongated holes are partially aligned with the contact at position 4/9 and fully aligned with the contact at position 5/8 while not aligned with the contact at position 6/7.

* * * * *